US008087598B2

(12) United States Patent
Leuteritz et al.

(10) Patent No.: US 8,087,598 B2
(45) Date of Patent: Jan. 3, 2012

(54) NOZZLE MODULE FOR AN INJECTION VALVE

(75) Inventors: Uwe Leuteritz, Regensburg (DE); Ferdinand Löbbering, Regensburg (DE)

(73) Assignee: Continental Automotive GmbH, Hannover (DE)

( * ) Notice: Subject to any disclaimer, the term of this patent is extended or adjusted under 35 U.S.C. 154(b) by 28 days.

(21) Appl. No.: 12/490,717

(22) Filed: Jun. 24, 2009

(65) Prior Publication Data

US 2010/0001101 A1 Jan. 7, 2010

(30) Foreign Application Priority Data

Jul. 2, 2008 (DE) ..... 10 2008 031 271

(51) Int. Cl.

| | |
|---|---|
| ***F02M 61/10*** | (2006.01) |
| ***F02M 61/16*** | (2006.01) |
| ***F02M 61/18*** | (2006.01) |

(52) U.S. Cl. ..... 239/533.11; 239/533.2; 239/533.9

(58) Field of Classification Search ..... 239/88–92, 239/95, 96, 533.2, 585.1–585.5, 533.3, 533.9, 239/533.11, 533.12

See application file for complete search history.

(56) References Cited

U.S. PATENT DOCUMENTS

| | | | | |
|---|---|---|---|---|
| 4,651,931 | A * | 3/1987 | Hans et al. | 239/533.9 |
| 6,047,905 | A | 4/2000 | Honda et al. | 239/533.2 |
| 2002/0179743 | A1 * | 12/2002 | Haeberer et al. | 239/533.12 |

FOREIGN PATENT DOCUMENTS

| | | | |
|---|---|---|---|
| DE | 19757299 | A1 | 6/1998 |
| DE | 10031537 | A1 | 3/2002 |
| DE | 10318989 | A1 | 11/2003 |
| WO | WO 2005095785 | A1 * | 10/2005 |

OTHER PUBLICATIONS

German Office Action, German application No. 10 2008 031 271.1-13, 4 pages, Apr. 29, 2009.

* cited by examiner

*Primary Examiner* — Darren W Gorman
(74) *Attorney, Agent, or Firm* — King & Spalding L.L.P.

(57) ABSTRACT

A nozzle module for an injection valve has a nozzle body with a recess with a wall, being operable to hydraulically couple the recess to a high pressure fluid circuit, a seal seat embodied on the wall, at least one nozzle needle arranged in an axially moveable fashion in the recess. The needle has a seat area with a sealing surface interacting with the seal seat to open and close the valve, respectively, and a supporting area, arranged radially outside and axially at a distance from the seat area and supporting the needle against the wall when the needle closes. The needle has at least one needle recess, which when the supporting area rests against the wall of the body recess, an area of the body recess facing axially away from the seat area is hydraulically coupled to an area of the body recess which axially faces the seat area.

6 Claims, 5 Drawing Sheets

FIG 2 II
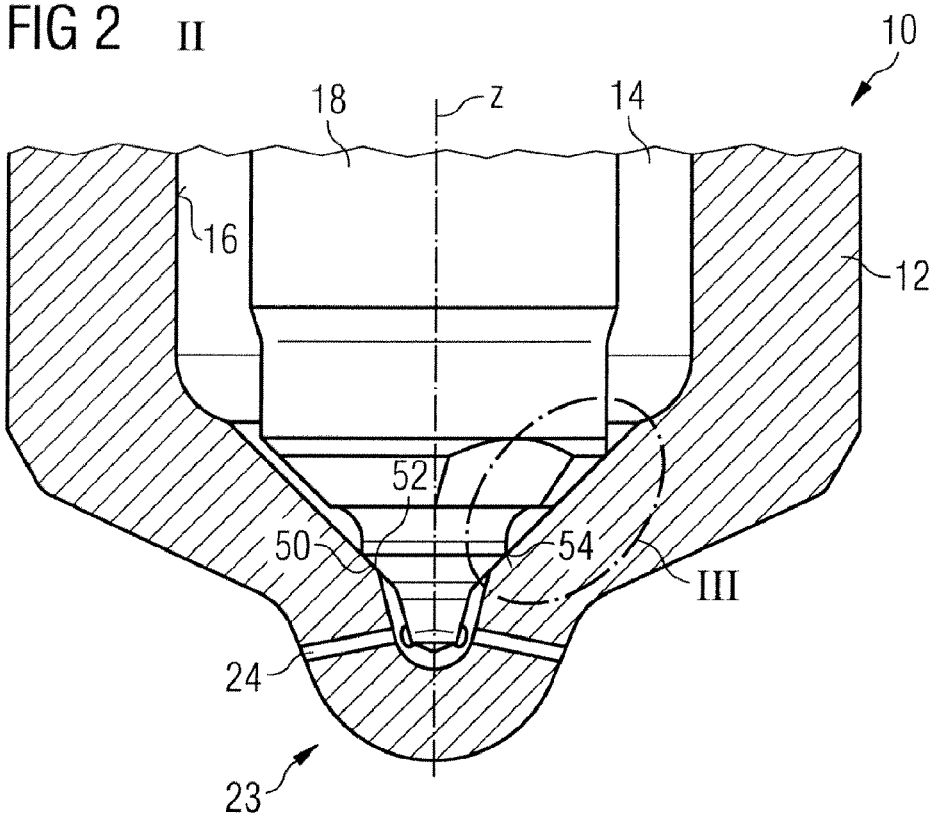
FIG 3 III
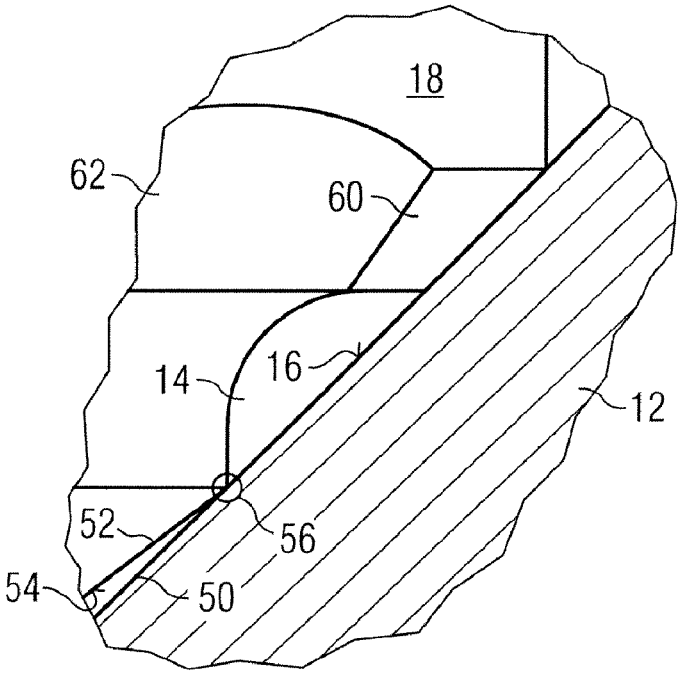

NOZZLE MODULE FOR AN INJECTION VALVE

CROSS-REFERENCE TO RELATED APPLICATIONS

This application claims priority to DE Patent Application No. 10 2008 031 271.1 filed Jul. 2, 2008, the contents of which is incorporated herein by reference in its entirety.

TECHNICAL FIELD

The invention relates to a nozzle module for an injection valve.

BACKGROUND

Ever more stringent statutory requirements relating to the permissible emission of harmful substances from internal combustion engines employed in motor vehicles make it necessary to adopt various measures by means of which the harmful emissions can be reduced. One approach here is to cut the harmful emissions generated by the internal combustion engine. The formation of soot depends greatly on the preparation of the air/fuel mixture in the particular cylinder of the internal combustion engine.

A correspondingly improved mixture preparation can be achieved if the fuel is metered at a very high pressure. In the case of diesel internal combustion engines, the fuel pressures amount to up to more than 2000 bar. High pressures of this type place high demands both on the material of the nozzle module and also on the structure thereof. At the same time, larger forces must be absorbed by the nozzle module.

SUMMARY

According to various embodiments, a nozzle module and an injection valve can be created which enable reliable and precise operation.

According to an embodiment, a nozzle module for an injection valve, may comprise—a nozzle body, which has a nozzle body recess with a wall, wherein the nozzle body recess can be hydraulically coupled to a high pressure circuit of a fluid, —a seal seat formed on the wall of the nozzle body recess, —at least one nozzle needle arranged in an axially moveable fashion in the nozzle body recess with a central axis, —wherein the nozzle needle comprises a seat area with a sealing surface and the sealing surface interacts with the seal seat such that in a closed position the nozzle needle prevents fluid from flowing through the at least one injection nozzle and in an open position releases a fluid flow through the at least one injection nozzle, —wherein the nozzle needle comprises a supporting area, which is arranged radially outside and axially at a distance from the seat area and which is operable to support the nozzle needle against the wall of the nozzle body recess when the nozzle needle is in the closed position, and —wherein the nozzle needle comprises at least one nozzle needle recess, which is arranged and embodied such that when the supporting area abuts the wall of the nozzle body recess, an area of the nozzle body recess, which axially faces away from the seat area in respect of the supporting area, is hydraulically coupled to an area of the nozzle body recess which axially faces the seat area in respect of the supporting area.

According to a further embodiment, the nozzle needle recess may be embodied as a groove in the supporting area. According to a further embodiment, the nozzle needle recess may be embodied as a through-channel in the supporting area. According to a further embodiment, the nozzle body may comprise several nozzle needle recesses, which, in respect of the central axis of the nozzle needle, are arranged distributed across the supporting area in a rotationally-symmetrically fashion. According to a further embodiment, the seat area and the supporting area may be embodied such that when the nozzle needle is in the open position, a minimal distance between the supporting area and the wall of the nozzle body recess is smaller than a minimal distance between the seat area and the wall of the nozzle body recess. According to a further embodiment, the seat area and the supporting area may be embodied such that in the open position of the nozzle needle, a minimal distance between the supporting area and the wall of the nozzle body recess is greater than a minimal distance between the seat area and the wall of the nozzle body recess.

According to another embodiment, an injection valve may comprise such a nozzle module as described above and an injector module, with the injector module being embodied to act on the nozzle module.

BRIEF DESCRIPTION OF THE DRAWINGS

Exemplary embodiments are described in more detail below with reference to the schematic drawings, in which;

FIG. 2 shows an enlarged representation of a detail II of FIG. 1 in the area of the valve seat with a nozzle body and a nozzle needle, FIG. 3 shows a further enlarged representation of a detail III of FIG. 2 in the area of the valve seat.

Elements of the same structure or function are provided with the same reference characters in all of the figures.

DETAILED DESCRIPTION

Figure 1:
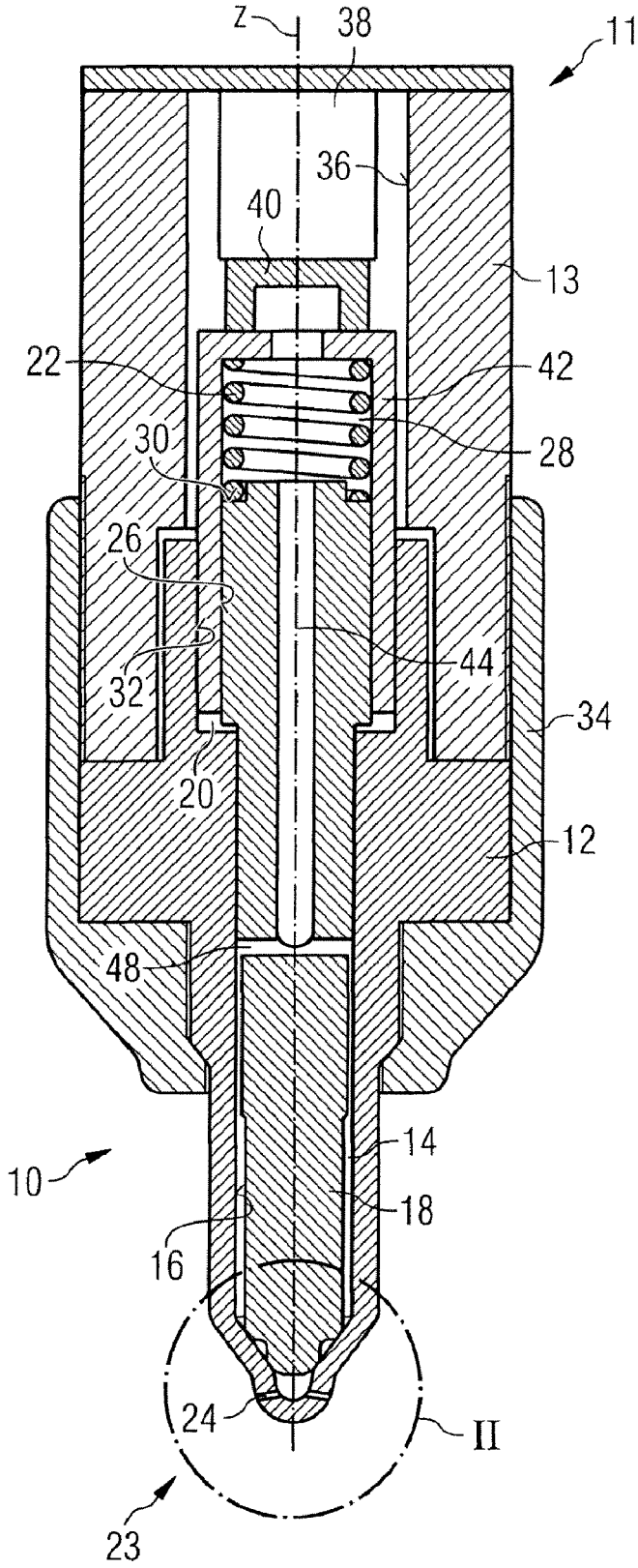
FIG. 1 shows a longitudinal section of the injection valve.

According to a first aspect, a nozzle module for an injection valve, may comprise a nozzle body, which has a nozzle body recess with a wall. The nozzle body recess can be hydraulically coupled to a high pressure circuit of the fluid. The nozzle module has a seal seat embodied on the wall of the nozzle module recess and at least one nozzle needle which is arranged so as to be axially moveable in the nozzle body recess, said nozzle needle having a central axis. The nozzle needle has a seat area with a sealing surface. The sealing surface interacts with the seal seat such that the nozzle needle, in a closed position, prevents fluid from flowing through the at least one injection nozzle and, in an open position, releases the fluid flow through the at least one injection nozzle. The nozzle needle has a supporting area, which is arranged radially outside and at an axial distance from the seat area, and is embodied so as to support the nozzle needle on the wall of the nozzle body recess when the nozzle needle is in the closed position. The nozzle needle has at least one nozzle needle recess, which is arranged and embodied such that when the supporting area abuts the wall of the nozzle body recess, a area of the nozzle body recess which axially faces away from the seat area in respect of the supporting area is hydraulically coupled to an area of the nozzle body recess which axially faces the seat area in respect of the supporting area, and the supporting area and the seat area of the nozzle needle are non-movably connected with respect to each other.

The at least one nozzle needle recess allows the fluid to flow between the areas of the nozzle body recess, which axially face away from the seat area in respect of the supporting area and areas of the nozzle body recess, which axially face the seat area in respect of the supporting area, even if the supporting area rests against the wall of the nozzle body recess.

This arrangement may be advantageous in that the force of the nozzle needle can be distributed on the seat area and the supporting area. The surface pressure on the seal seat can be kept to a minimum. This allows wear of the nozzle body or of the nozzle needle to be prevented or kept to a minimum. A change in the opening time of the nozzle needle and thus of the injection quantity over the service life of the injection valve can be prevented. Introducing the force of the nozzle needle onto the nozzle body can take place at a large radial distance from the central axis of the nozzle needle, so that the nozzle body, in particular in the area of the nozzle cone near to the central axis, can be subject to a smaller load.

In a further embodiment, the nozzle needle recess can be embodied as a groove in the supporting area. This may be advantageous in that the nozzle needle recess can be easily introduced into the nozzle needle, for instance by means of milling.

In a further embodiment, the nozzle needle recess can be embodied as a through-channel in the supporting area. This allows the nozzle needle recess to be easily inserted into the nozzle needle, for instance through holes.

In a further embodiment, the nozzle body may have several nozzle needle recesses, which, in respect of the central axis of the nozzle needle, are arranged distributed over the supporting area in a rotationally symmetrical fashion. A rotationally symmetrical distribution of the nozzle needle recesses across the circumference of the nozzle body can result in a particularly uniform flow of fluid through the nozzle needle recesses across the circumference of the nozzle needle.

In a further embodiment, the seat area and the supporting area can be embodied such that when the nozzle needle is in the open position, a minimum distance between the supporting area and the wall of the nozzle body recess is smaller than a minimum distance between the seat area and the wall of the nozzle body recess. This allows force to be transferred from the nozzle needle onto the nozzle body during the whole period of contact between the nozzle needle and the seal seat.

In a further embodiment, the seat area and the supporting area can be embodied such that in the open position of the nozzle needle, a minimum distance between the supporting area and the wall of the nozzle body recess is greater than a minimum distance between the seat area and the wall of the nozzle body recess. It is thus possible to prevent an overdimensioning of a contact between the nozzle needle and the wall of the nozzle body recess.

According to a second aspect, an injection valve may comprise a nozzle module according to the first aspect and an injector module. The injector module is embodied so as to act on the nozzle module.

FIG. 1 shows an injection valve with a nozzle module 10 and an injector module 11. The injector module 11 functionally interacts with the nozzle module 10.

The nozzle module 10 has a nozzle body 12, the injector module 11 has an injector body 13. The nozzle body 12 is permanently fastened to the injector body 13 by means of a nozzle clamping nut 24. The nozzle body 12 and the injector body 13 thus form a common housing of the injection valve.

The injector body 13 has a recess 36 in which an actuator 38 is arranged. The actuator 38 is embodied as a stroke actuator and is preferably a piezoactuator, which includes a stack of piezoelectric elements. The piezoactuator changes its axial extension as a function of an applied voltage signal. The actuator can however also be embodied as another actuator which is known to the person skilled in the art for this purpose and is known to be suitable.

The actuator 38 acts on a stroke converter by way of a transformer 40. The stroke converter includes a cup-shaped body 42, which is arranged in a nozzle body recess 14 of the nozzle body 12 and is preferably guided herein. In this exemplary embodiment the cup-shaped body 42 protrudes into the recess 36 of the injector body 13. The nozzle body recess 14 has a wall 16. A nozzle needle 18 with a central axis Z is arranged in the nozzle body recess 14, the latter forming the nozzle module 10 together with the nozzle body 12.

The nozzle needle 18 is hydraulically coupled to the cup-shaped body 42 by way of a transformer chamber 20. The transformer chamber 20 is delimited by a frontal surface embodied on the cup edge of the cup-shaped body 42, by a projection on the nozzle body recess 14 and by a projection of the nozzle needle 18.

The nozzle needle 18 is guided into an area of the nozzle body recess 14. It is also prestressed by means of a nozzle spring 22, such that it prevents fluid from flowing through an injection nozzle arranged in a nozzle cone 23 of the nozzle body 12, if no additional forces act on the nozzle needle 16. The nozzle spring 22 is arranged in a high pressure chamber 28 which is restricted by the cup base of the cup-shaped body 42, a sub area of its cylindrical cup wall and a front surface 30 of the nozzle needle 18.

The high pressure chamber 28 can be coupled to a high pressure circuit of the fluid (not shown). It is coupled to the high pressure circuit when the injection valve is in an installed state.

The nozzle spring 22 rests on the one hand against the cup base of the cup-shaped body 42 and rests on the other hand against the front surface 30 of the nozzle needle 18. It is prestressed accordingly and thus exerts a force, which acts in the closing direction, on the nozzle needle 18.

A first gap 26 is embodied between the nozzle needle 18 and the outer cup-shaped body 42. A second gap 32 is also embodied between the cup-shaped body 42 and the nozzle body 12. The transformer chamber 20 can be hydraulically coupled to the high pressure circuit by way of the second gap 32. The clearances of the gaps 26, 32 are selected such that rapid, brief movements of the actuator 38 can essentially be converted in a manner free of stroke loss. On the other hand, the clearances of the gaps 26, 32 are selected to be sufficiently large to ensure that fluid can flow between the high pressure circuit and the transformer chamber 20 on the one hand and between the transformer chamber 20 and the high pressure chamber 28 on the other hand.

When actuating the actuator 38, the nozzle needle 18 is firstly moved from its closed position into its open position with a continual axial extension of the actuator 38, in which open position said nozzle needle releases the fluid flow through the injection nozzle 24.

A longitudinal bore 44 is introduced into the nozzle needle 18, by which the nozzle needle 18 is penetrated from its side facing the cup base of the cup-shaped body 12 at least along a part of its axial extension. The longitudinal bore 44 opens into a radial bore 48, which is aligned radially outwards. The fluid, in particular the fuel, can thus pass through the longitudinal bore 44 and the radial bore 48 from the high pressure chamber 28. The fluid flows from the radial bore 48 through an intermediate space between the nozzle needle 18 and the nozzle body 12 to the first injection nozzle 24.

The nozzle cone 23 or sections thereof are shown enlarged in FIGS. 2 to 7 in each instance.

FIG. 2 shows an enlarged representation of a cutout II in FIG. 1 in the area of the nozzle cone 23 of the nozzle module 10.

The nozzle body 12 has a seal seat 50 on the wall 16 of the nozzle body recess 14. The nozzle needle 18 has a seat area 52 with a sealing surface 54, which is embodied in the manner of a cone-shaped shell. The sealing surface 54 of the nozzle needle 18 interacts with the seal seat 50 of the nozzle body 12 such that the nozzle needle 18 prevents fluid from flowing through the at least one injection nozzle 24 in a closing position and releases a fluid flow through the at least one injection nozzle 24 in an open position. Several injection nozzles 24 can also be embodied in the nozzle body 12, said injection nozzles possibly forming an injection hole circuit.

When the nozzle needle 18 is in a closed position, at least one contact line 56 is embodied between the seal seat 50 and the sealing surface 54 of the nozzle needle 18, which prevents a passage through the injection nozzle 24.

The nozzle needle 18 has a supporting area 60 in a radial position outside and axially distanced from the seat area 52 of the nozzle needle 18. This can support the nozzle needle 18 against the wall 16 of the nozzle body recess 14 in a closed position of the nozzle needle 18.

The nozzle needle 18 has at least one nozzle needle recess 62. When the supporting area 60 rests against the wall 16 of the nozzle body recess 14, the nozzle needle recess 62 ensures that fluid can flow between areas of the nozzle body recess 14, which axially face away from the seat area 52 in respect of the supporting area 60 and areas of the nozzle body recess 14, which axially face the seat area 52 in respect of the supporting area 60.

If the nozzle needle 18 is in a closed position, the supporting area 60 allows the force of the nozzle needle 18 to be distributed onto the seat area 52 and the supporting area 60. The surface pressure on the seal seat 50 can thus remain at a minimum. Wear of the nozzle body 12 as well as also of the nozzle needle 18 can thus also be prevented. It is easily possible to prevent the opening time of the nozzle needle 18 and thus the injection quantity from changing over the service life of the injection valve. Since the force of the nozzle needle 18 can be introduced into the nozzle body 12 across the supporting area 60 at a large radial distance from the central axis Z, the nozzle body 12 is only subject to minimal load in the area of the nozzle cone 23.

In the embodiment present here, the nozzle needle recess 62 is embodied as a groove in the nozzle needle 18. The nozzle needle recess 62 is, in this case, preferably produced by a machining method, for instance by means of milling.

Figure 4:
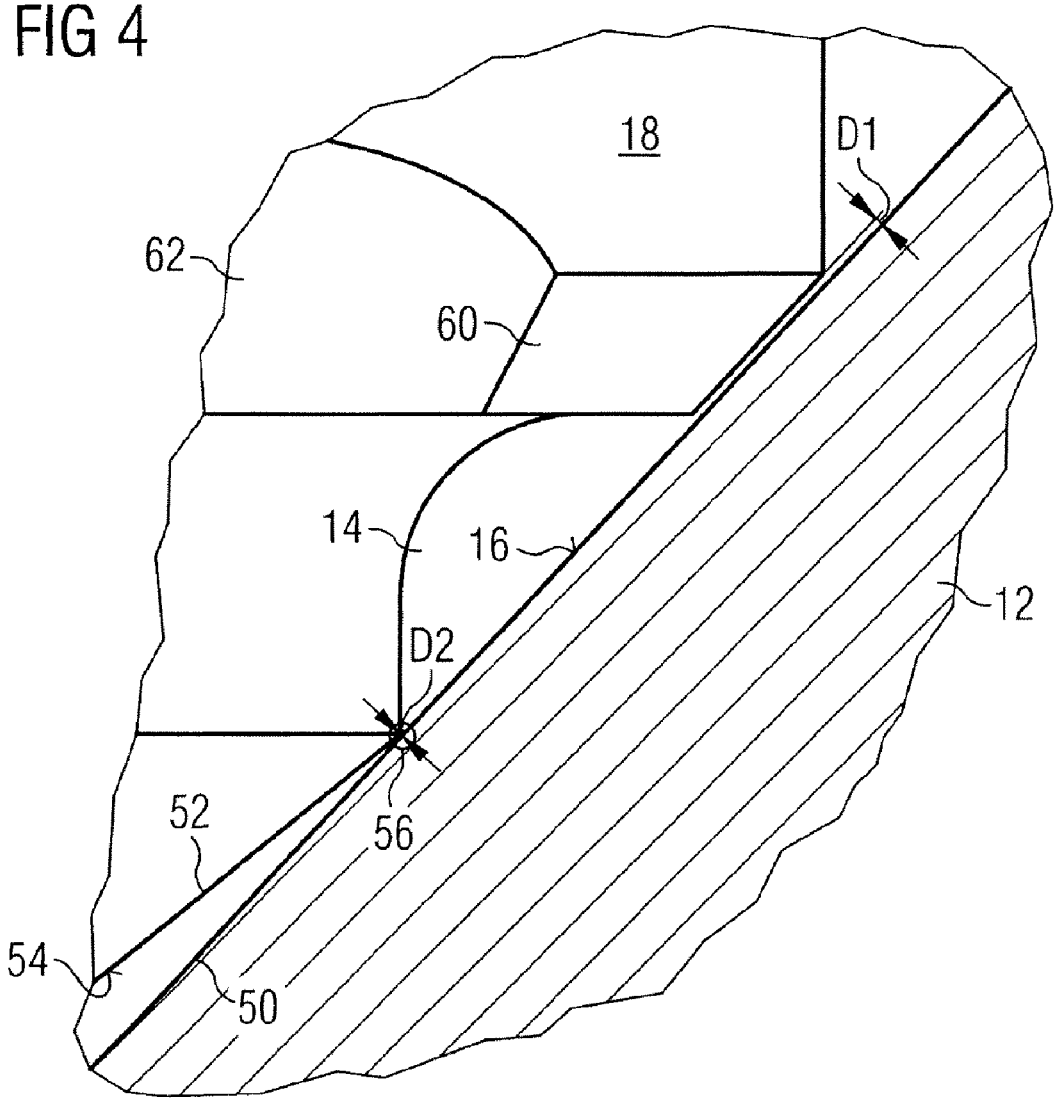
FIG. 4 shows a further detail of the nozzle body and the nozzle needle in the area of the valve seat.

FIG. 4 shows an enlarged drawing of a cutaway of the nozzle needle 18 and of the nozzle body 12. The nozzle needle 18 is shown in a position here, in which contact is formed by way of the contact line 56 between the seal seat 50 and the sealing surface 54. A distance D1 exists between the supporting section 60 and the wall 16 of the nozzle body recess 14. In other words, this means that when the nozzle needle 18 is in the open position, the minimal distance D1 between the supporting section 60 and the wall 16 of the nozzle body recess is greater than a minimal distance D2 between the seat area 52 and the wall 16 of the nozzle body recess 14. When the nozzle needle 18 strikes the nozzle body 12 during the closing process of the injection valve, overdimensioning of the contact between the nozzle needle 18 and the wall 16 of the nozzle body recess 14 can be prevented. During the further course of the closing process, the nozzle body 12 can give elastically in the area of the seal seat of the nozzle needle 18 and the supporting area 60 can rest against the wall 16 of the nozzle body recess 14. The supporting area 60 thus provides a supporting function for the nozzle needle 18. The difference between the minimal distance D1 between the supporting area 60 and the wall 16 of the nozzle body recess 15 and the minimal distance D2 between the seat area 52 and the wall 16 of the nozzle body recess 14 preferably amounts to 2 to 10 μm.

Figure 5:
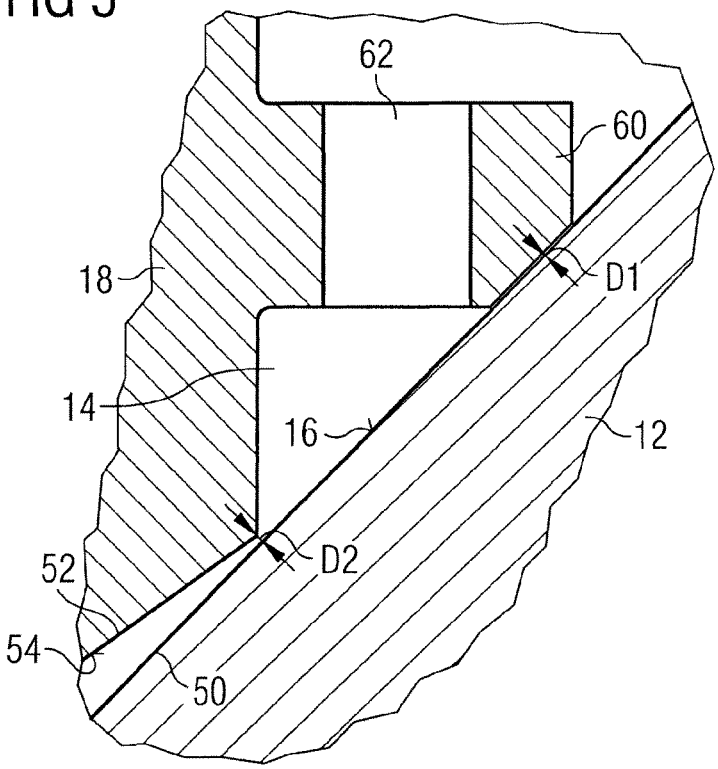
FIG. 5 shows a further detail of the nozzle body and the nozzle needle in the area of the valve seat.
Figure 6:
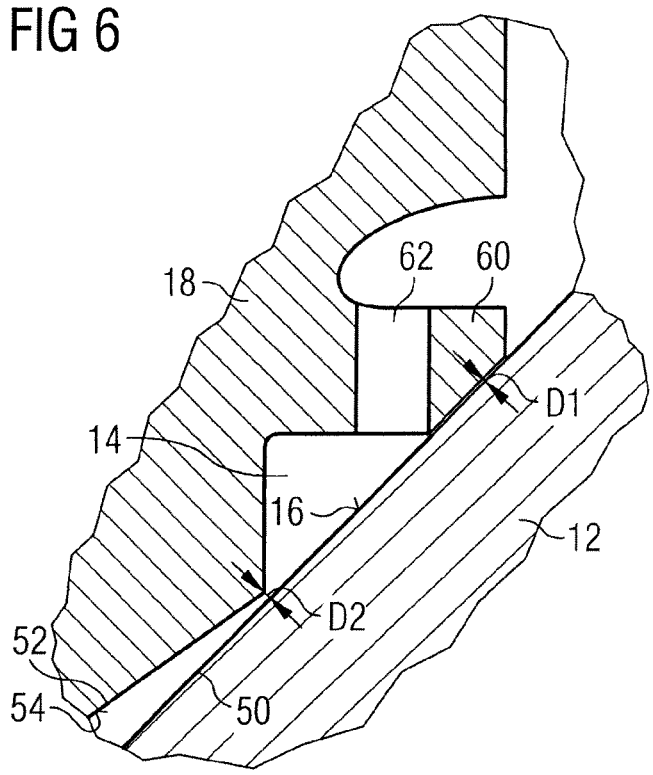
FIG. 6 shows a further detail of the nozzle body and the nozzle needle in the area of the valve seat.

FIGS. 5 and 6 indicate additional embodiments of the injection valve with an enlarged drawing of the nozzle needle 18 and of the nozzle body 12 in the area of the nozzle cone 23. The nozzle needle recess 62 is embodied here as a through-channel in the supporting area 60. A nozzle needle recess 62 of this type can be easily introduced into the nozzle needle 18 by means of drilling for instance.

In the embodiments shown in FIGS. 5 and 6, when the nozzle needle 18 strikes the nozzle body 12, the supporting area 60 rests against the wall 16 of the nozzle body recess 14, while a distance D2 exists between the seat area 52 and the wall 16 of the nozzle body recess 14. This means that when the nozzle needle 18 is in the open position, the minimum distance D2 between the seat area 52 and the wall 16 of the nozzle body recess 14 is greater than the minimum distance D1 between the supporting section and the wall 16 of the nozzle body recess 14. With a further closure of the nozzle needle 18, the seat area 52 of the nozzle needle 18 also contacts the wall 16 of the nozzle body recess 14. An embodiment of this type ensures that the force is introduced from the nozzle needle 18 onto the nozzle body 12 during the whole period of time in terms of contact between the sealing surface 54 of the nozzle needle 18 and the seal seat 50. The difference between the minimum distance D1 between the supporting area 60 and the wall 16 of the nozzle body recess 14 and the minimum distance D2 between the seat area 52 and the wall 16 of the nozzle body recess 14 preferably amounts to 2 to 10 μm.

Figure 7:
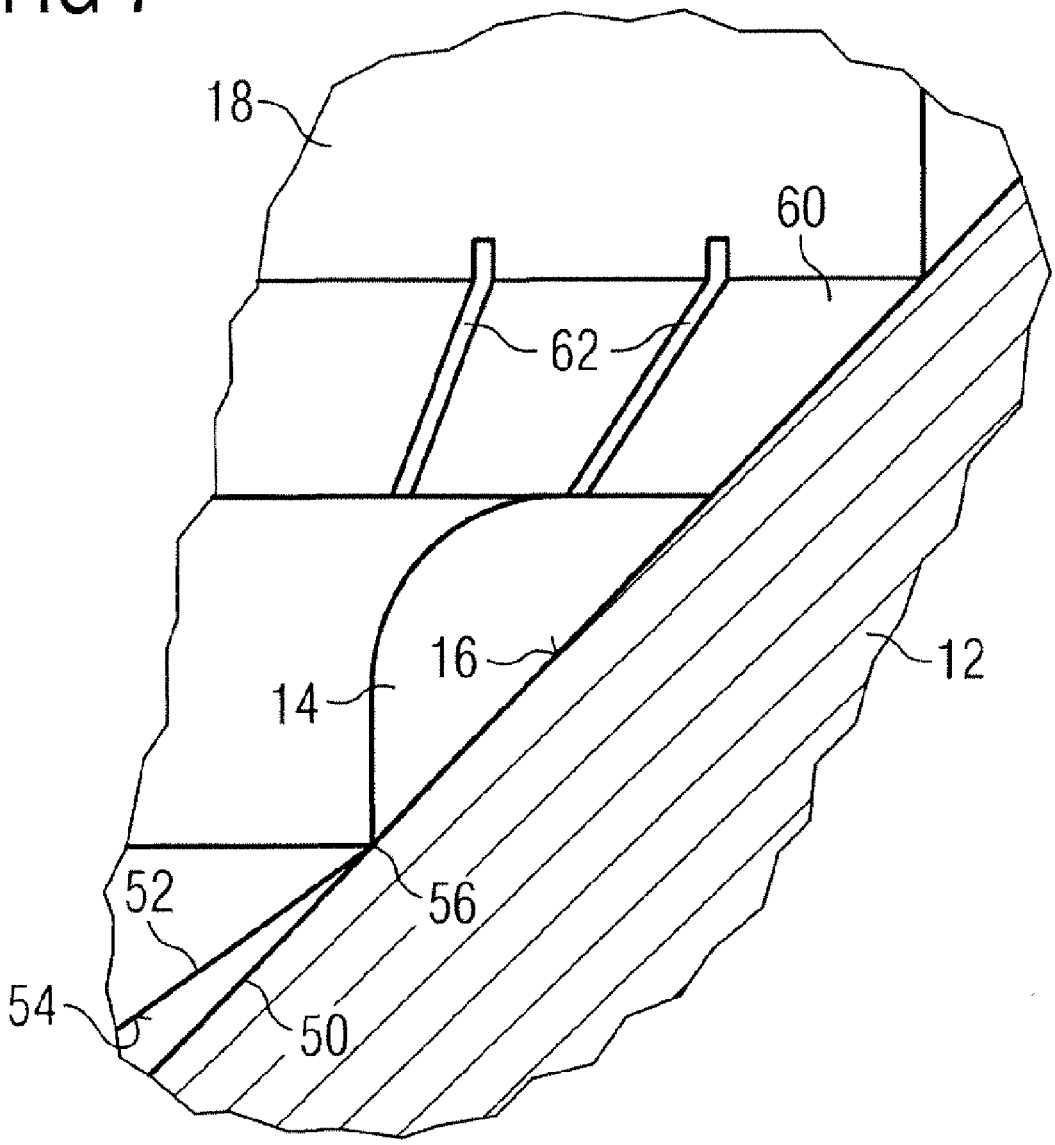
FIG. 7 shows a further detail of the nozzle body and the nozzle needle in the area of the valve seat.

FIG. 7 shows an enlarged cutout of an additional embodiment of the nozzle needle 18 and of the nozzle body 12. The nozzle needle recesses 62 are embodied here as grooves with a rectangular cross-section in the supporting area 60. Grooves of this type with a rectangular cross-section can be manufactured particularly easily. In particular, the nozzle body 12 has several nozzle needle recesses 62, which are arranged distributed over the supporting area 60 in a rotationally-symmetrical fashion in respect of the central axis Z of the nozzle needle 18. A rotationally-symmetrical distribution of the nozzle needle recess 62 of this type across the circumference of the nozzle needle 18 enables a particularly uniform passage of fluid through the nozzle needle recesses 62 over the entire circumference of the nozzle needle 18.

The nozzle needle recesses 62 are preferably produced by means of laser cutting.

By dividing the force of the nozzle needle 18 acting upon the nozzle body 12 onto the seal seat 50 and the supporting area 60, the surface pressure on the seal seat 50 can be reduced. If the supporting area 60 presses against the wall 16 of the nozzle body recess 14 due to the effective force of the nozzle needle 18, the resulting elastic deformation in the nozzle body 12 leads to the nozzle needle 18 deflecting in the area of the seal seat 50 of the nozzle body 12. A good seal is thus achieved between the seat area 52 and the seal seat 50 of the nozzle body 12.

The nozzle needle recesses 62 prevent the fluid flow in the nozzle body recess 14 from being influenced. If a short seat length and a small seat diameter are needed, in addition to the claimed reduction in surface pressure, a displacement of the main direction of the force of the nozzle needle 18 onto the nozzle body 12 axially outwards from the area of the nozzle cone 23 can be achieved. Minimal wear of the seal seat 50 and thus a small quantity drift of the fluid can thus be achieved during the injection process. Overall, high hydraulic robustness of the injection valve can be achieved by embodying the supporting area 60 on the nozzle needle 18.

What is claimed is:

1. A nozzle module for an injection valve, comprising a nozzle body, which has a nozzle body recess with a wall, wherein the nozzle body recess can be hydraulically coupled to a high pressure circuit of a fluid, a seal seat formed on the wall of the nozzle body recess, at least one nozzle needle arranged in an axially moveable fashion in the nozzle body recess with a central axis, wherein the nozzle needle comprises a seat area with a sealing surface and the sealing surface interacts with the seal seat such that in a closed position the nozzle needle prevents fluid from flowing through the nozzle module and in an open position releases a fluid flow through the nozzle module, wherein the nozzle needle comprises a supporting area, which is arranged radially outside and axially at a distance from the seat area and which is operable to support the nozzle needle against the wall of the nozzle body recess when the nozzle needle is in the closed position, and which is spaced apart from the wall of the nozzle body recess when the nozzle needle is in the open position to allow fluid passage between the supporting area and the wall of the nozzle body recess, wherein the nozzle needle comprises at least one nozzle needle recess embodied as a through-channel in the supporting area, the at least one nozzle needle recess being arranged and embodied such that when the supporting area abuts the wall of the nozzle body recess, an area of the nozzle body recess, which axially faces away from the seat area in respect of the supporting area, is hydraulically coupled to an area of the nozzle body recess which axially faces the seat area in respect of the supporting area; and wherein the supporting area and the seat area of the nozzle needle are non-movably connected with respect to each other.

2. The nozzle module according to claim 1, wherein the seat area and the supporting area are embodied such that when the nozzle needle is in the open position, a minimal distance between the supporting area and the wall of the nozzle body recess is smaller than a minimal distance between the seat area and the wall of the nozzle body recess.

3. An injection valve comprising:

a nozzle module which comprises:

a nozzle body, which has a nozzle body recess with a wall, wherein the nozzle body recess can be hydraulically coupled to a high pressure circuit of a fluid, a seal seat formed on the wall of the nozzle body recess, one and only one nozzle needle arranged in an axially moveable fashion in the nozzle body recess with a central axis, wherein the nozzle needle comprises a seat area with a sealing surface and the sealing surface interacts with the seal seat such that in a closed position the nozzle needle prevents fluid from flowing through the injection valve and in an open position releases a fluid flow through the injection valve, wherein the nozzle needle comprises a supporting area, which is arranged radially outside and axially at a distance from the seat area and which is operable to support the nozzle needle against the wall of the nozzle body recess when the nozzle needle is in the closed position, and which is spaced apart from the wall of the nozzle body recess when the nozzle needle is in the open position to allow fluid passage between the supporting area and the wall of the nozzle body recess, and wherein the nozzle needle comprises at least one nozzle needle recess embodied as a through-channel in the supporting area, the at least one nozzle needle recess being arranged and embodied such that when the supporting area abuts the wall of the nozzle body recess, an area of the nozzle body recess, which axially faces away from the seat area in respect of the supporting area, is hydraulically coupled to an area of the nozzle body recess which axially faces the seat area in respect of the supporting area; and an injector module, with the injector module being operable to act on the nozzle module.

4. The injection valve according to claim 3, wherein the seat area and the supporting area are embodied such that when the nozzle needle is in the open position, a minimal distance between the supporting area and the wall of the nozzle body recess is smaller than a minimal distance between the seat area and the wall of the nozzle body recess.

5. A method of operating a nozzle module for an injection valve, comprising the steps of:

providing a nozzle body, which has a nozzle body recess with a wall, wherein the nozzle body recess can be hydraulically coupled to a high pressure circuit of a fluid, forming a seal seat on the wall of the nozzle body recess, arranging at least one nozzle needle in an axially moveable fashion in the nozzle body recess with a central axis, actuating the nozzle needle which comprises a seat area with a sealing surface thus that the sealing surface interacts with the seal seat such that in a closed position the nozzle needle prevents fluid from flowing through the injection valve and in an open position releases a fluid flow through the injection valve, wherein, when the nozzle needle is in the closed position, a supporting area of the nozzle needle, which is arranged radially outside and axially at a distance from the seat area, supports the nozzle needle against the wall of the nozzle body recess, and when the nozzle needle is in the open position, the supporting area of the nozzle needle is spaced apart from the wall of the nozzle body recess to allow fluid passage between the supporting area and the wall of the nozzle body recess, and wherein, when the supporting area abuts the wall of the nozzle body recess, at least one nozzle needle recess of the nozzle needle is arranged and embodied such that an area of the nozzle body recess, which axially faces away from the seat area in respect of the supporting area, is hydraulically coupled to an area of the nozzle body recess which axially faces the seat area in respect of the supporting area, wherein the at least one nozzle needle recess is embodied as a through-channel in the supporting area, and wherein the supporting area and the seat area of the nozzle needle are non-movably connected with respect to each other.

6. The method according to claim 5, wherein when the nozzle needle is in the open position, a minimal distance between the supporting area and the wall of the nozzle body recess is smaller than a minimal distance between the seat area and the wall of the nozzle body recess.

* * * * *